US006027774A

United States Patent [19]

Fine et al.

[11] Patent Number: 6,027,774

[45] Date of Patent: Feb. 22, 2000

[54] PHOTO DISPLAY GLOBE WITH LIQUID FILLED SHELL

[75] Inventors: Neil Fine, Northbrook, Ill.; Cliff Lam, Tsuen Wan, The Hong Kong Special Administrative Region of the People's Republic of China

[73] Assignee: Neil Enterprises, Inc., Vernon Hills, Ill.

[21] Appl. No.: 09/044,039

[22] Filed: Mar. 18, 1998

[51] Int. Cl.[7] ..... G09F 19/00

[52] U.S. Cl. ..... 428/14; 40/406; 40/410; 446/267

[58] Field of Search ..... 428/13, 14; 40/406, 40/410; 446/267

[56] References Cited

U.S. PATENT DOCUMENTS

| | | | |
|---|---|---|---|
| 777,305 | 12/1904 | Priestnall . | |
| 1,777,944 | 10/1930 | Trovato . | |
| 2,144,551 | 1/1939 | Skolnick . | |
| 2,200,696 | 5/1940 | L'Heureux . | |
| 2,518,502 | 8/1950 | Snyder . | |
| 2,548,706 | 4/1951 | Corning . | |
| 2,636,597 | 4/1953 | Hinz . | |
| 3,822,782 | 7/1974 | Ringle et al. . | |
| 4,353,327 | 10/1982 | Shroyer . | |
| 4,771,902 | 9/1988 | Teng | 40/410 |
| 4,837,955 | 6/1989 | Grabhorn . | |
| 4,879,824 | 11/1989 | Galloway . | |
| 4,889,748 | 12/1989 | Dudley . | |
| 5,125,175 | 6/1992 | Huff, Jr. . | |
| 5,261,848 | 11/1993 | Kaplan et al. . | |
| 5,292,564 | 3/1994 | Lee . | |
| 5,442,869 | 8/1995 | McDarren et al. . | |
| 5,853,824 | 12/1998 | Liu | 428/13 |

FOREIGN PATENT DOCUMENTS

| | | |
|---|---|---|
| 2067084 | 8/1971 | France . |

*Primary Examiner*—Alexander Thomas
*Attorney, Agent, or Firm*—Factor and Shaftal, LLC

[57] ABSTRACT

A liquid-filled display globe is provided. The globe has a central dry chamber allowing objects to be displayed without immersion, while giving the appearance of being immersed. Particulate matter is suspended in the liquid, giving the appearance of swirling snowflakes when the liquid is agitated. A removable base provides access to the display chamber so that the object displayed therein can be easily replaced.

21 Claims, 1 Drawing Sheet

21b
35
20
65
30
33
21
21a
31
66
40
5
47
48
45
46
43
44
42
25
27
38
26
60
29
22
22a
28a
28
57
32
23
39
55a
56
51
50
34

PHOTO DISPLAY GLOBE WITH LIQUID FILLED SHELL

BACKGROUND OF THE INVENTION

1. The Technical Field

The invention relates to novelty display globes in general, and, more particularly, to a novelty display globe having a liquid-filled shell and a central, dry, display chamber.

2. The Prior Art

Display globes having liquid-filled shells have long been known in the art. Such display globes typically comprise a statuette or other object contained in a transparent shell which is filled with a liquid to which particulate matter has been added. The liquid and particulate may be agitated to give the effect of snow swirling about the object contained in the shell. With this type of display globe, the object which is to be displayed within the globe is, by design, in direct contact with the liquid. As such, this type of globe is generally limited to use with display objects which are impervious to immersion in liquid. Furthermore, this type of display globe is typically of permanently sealed construction. Therefore, the display items or objects housed therein typically cannot be replaced by the ultimate user, without damaging the globe.

A second type of display globe which has long been known in the art typically comprises a liquid-filled annular shell which is placed over a statuette or other object which is, in turn, supported on a base. Particulate matter has typically been added to the liquid in the annular shell, giving the effect of swirling snow when the liquid is agitated. With this type of globe, the item to be displayed remains dry. As such, this type of display globe is particularly well suited for use with display items which cannot readily be immersed in a liquid without becoming damaged, such as display items comprising paper articles.

As a practical matter, at least a portion of the display item housed in the second type of display globe will be relatively distant from the liquid-filled, annular shell. Because the display item is so far removed from and, of course, not immersed in the liquid, the "swirling snow" effect produced by the particulate matter in the liquid is less dramatic in the second type of display globe as compared to the first type.

Thus, it is an object of the present invention to provide a liquid-filled display globe which can be used to display items without immersing the items in the liquid.

It is another object of the invention to provide such a display globe in which the item to be displayed, although not immersed in the liquid, is sufficiently proximate the liquid to give the appearance that it is immersed therein.

It is a further object of the present invention to provide a liquid-filled display globe in which the display items can be easily replaced by the user, without damaging the globe.

These and other objects of the invention will become apparent in light of the present specification, claims, and drawings.

SUMMARY OF THE INVENTION

The present invention is a novelty item comprising a housing having an outer portion and an inner portion and comprising an upper shell and a bottom portion which cooperate to define a liquid-tight cavity therebetween. A liquid-tight display chamber is integral with the housing, with the display chamber extending from the outer portion of the housing into the cavity. The display chamber has an interior region and an exterior region. The housing incorporates an aperture for providing access to the interior region of said display chamber. A liquid is received in the cavity so as to provide a cavity which is substantially liquid filled. The interior region of the display chamber is shielded from direct contact with the liquid so as to provide a substantially liquid-free display chamber.

The exterior region of the display chamber can have a front wall, which may be substantially rectangular. The display chamber can be configured to receive a thin object, such as a thin sheet. Support means, which may be a piece of expanded foam, may be provided within the display chamber for supporting the thin object behind the front wall of the display chamber.

At least a portion of the upper shell may be substantially transparent, while at least a portion of the upper shell may be substantially opaque. The upper shell may be substantially dome shaped.

The housing may further comprise drainage means which may comprise a drain port located within the bottom portion of the housing and a plug operatively associated with the drain port for selectively sealing the liquid within the housing. The drain port may be integral with the bottom portion. The liquid may contain a plurality of particles therein.

A base may be provided for supporting the housing. The base may be configured to cover the aperture on the bottom portion and may be removable from the housing.

DETAILED DESCRIPTION OF THE INVENTION

Figures 1, 2, 3, 4, 5, 6:
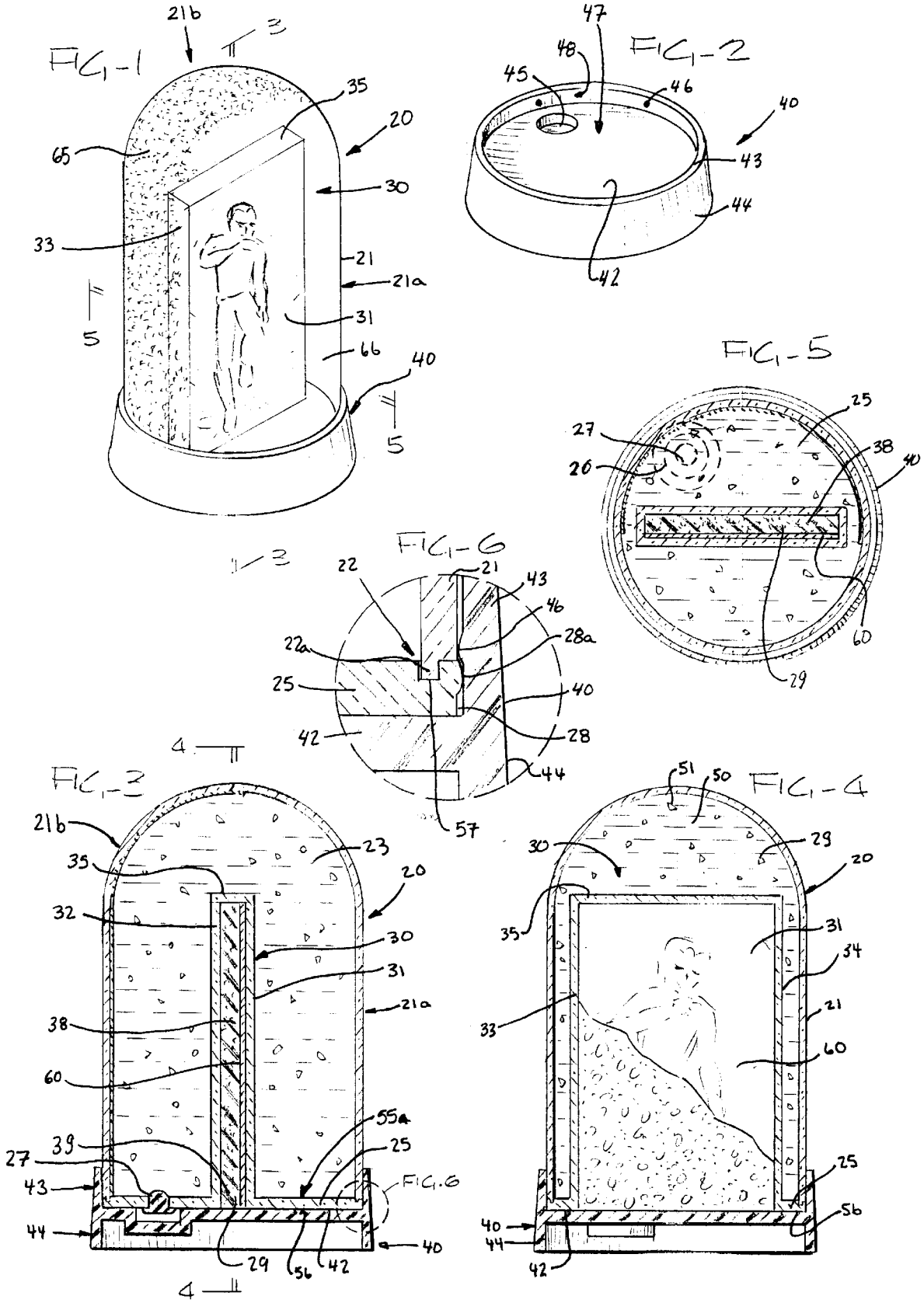
FIG. 1 is a perspective view of a photo display globe comprising an upper housing and a base.
FIG. 2 is a perspective view of a base for a photo display globe.
FIG. 3 is a side sectional elevation view of a photo display globe comprising an upper housing and a base.
FIG. 4 is a front sectional elevation view of a photo display globe comprising an upper housing and a base.
FIG. 5 is a top sectional plan view of a photo display globe.
FIG. 6 is a side sectional detail view of an interface between an upper housing of a photo display globe and a base for a photo display globe.

While this invention is susceptible of embodiment in many forms, there is shown in the drawings, and will be described in detail herein, a preferred embodiment, with the understanding that the present disclosure is to be considered an example of the principles of the invention and is not intended to limit the invention to the embodiment illustrated.

The drawings illustrate a photo display globe according to a preferred embodiment of the invention. The photo display globe comprises housing 20, display chamber 30, liquid 50, and may also include base 40. In particular, referring to FIGS. 1, 3, and 5, housing 20 comprises upper shell 21, bottom 25, and aperture 29. Housing 20 may further include drain port 26 and a drain plug 27.

Upper shell 21 is illustrated as having substantially cylindrical side wall portion 21*a* that is coextensive with and integrally associated with substantially hemispherical top wall portion 21*b*. It is contemplated that upper shell 21 may be of other shapes, as well, such as cubic, for example. Referring also to FIG. 6, upper shell 21 includes bottom edge 22 which may further comprise longitudinally-extending tab 22*a*.

Bottom 25, as shown in FIGS. 3 and 6, includes inner surface 55, outer surface 56, peripheral edge 28, and outwardly projecting peripheral ridge 28*a* integrally associated with peripheral edge 28. Inner surface 55 of bottom 25 may further comprise groove 57 which is sized and shaped to substantially conform with the shape and dimensions of bottom edge 22 and/or tab 22*a* of upper shell 21. In a preferred embodiment, bottom 25 is substantially planar and circular and includes groove 57 located adjacent peripheral edge 28. In alternate embodiments, bottom 25 may be of different shapes and cross sections, such as square.

In a preferred embodiment, bottom 25 may further comprise an aperture defining drain port 26. Embodiments which comprise drain port 26 also comprise drain plug 27 which may be removably inserted into drain port 26. Although the drawings illustrate drain port 26 and drain plug 27 as being associated with bottom 25, it is contemplated that the drain port and drain plug may be associated with other portions of the housing 20, such as upper shell 21.

Bottom edge 22 of upper shell 21 cooperates with bottom 25 to form a liquid-tight inner portion or cavity 23. In a preferred embodiment, tab 22*a* extending from bottom edge 22 of upper shell 21 matingly engages with circumferential groove 57 in bottom 22. In order to enhance the housing's 20 desired liquid-tight characteristics, tab 22*a* may be chemically bonded to groove 57 using a suitable adhesive. Alternatively, or additionally, a suitable sealant may be applied to the tab/groove interface after tab 22*a* and groove 57 have been assembled.

Display chamber 30 is illustrated in FIGS. 1, 3, and 4 as comprising front wall 31, rear wall 32, two side walls 33 and 34, and top wall 35, which cooperate to define a substantially rectangular chamber having an interior region, an exterior region, and an open bottom 39. Front wall 31 is contemplated to be substantially transparent. The display chamber may further comprise support member 38. In a preferred embodiment, display chamber 30 is configured to receive thin object 60. In other embodiments, display chamber 30 may have more or fewer walls so as to define other shapes.

Display chamber 30 is integral with housing 20 and extends from the outer portion of the housing into an interior region (cavity 23) of the housing, so that the exterior region of the display chamber is substantially coextensive with cavity 23. In a preferred embodiment, display chamber 30 is substantially integral with bottom 25, extending from the outer portion of housing 20 into cavity 23. Alternatively, display chamber 30 may be integral with any other suitable portion of the housing, such as cylindrical side wall portion 21*a* of upper shell 21.

Referring to FIG. 5, open bottom 39 of display chamber 30 is coextensive with aperture 29. Thin object 60, which may be a photograph or similar thin sheet, may be inserted into interior region of display chamber 30 through aperture 29 so as to be substantially viewable through substantially transparent upper shell 21 and substantially transparent front wall 31 of the display chamber. Support member 38 comprising, for example, a piece of expanded foam having dimensions substantially similar to the dimension of the interior region of display chamber 30, may be placed between thin object 60 and rear wall 32 of the display chamber so as to maintain the thin object in abutting relationship with the front wall.

Liquid 50 is contemplated to be substantially transparent and to have a desired, predetermined specific gravity and viscosity. Liquid 50 may include particles 51 which may become suspended in the liquid when the liquid is agitated. It is contemplated that cavity 23 be substantially entirely filled with liquid 50. Liquid 50 may be introduced into cavity 23 through drain port 26, whereafter drain plug 27 may be installed to preclude undesired loss of the liquid from the cavity.

Base 40, as illustrated in FIGS. 2 through 4, comprises web 42, upper wall 43, lower wall 44, well 45, and a plurality of bumps 46. In a preferred embodiment, web 42 is substantially planar and circular. Upper wall 43 extends upward from the web 42, defining recess 47, while lower wall 44 extends downward from the web. Bumps 46 are contemplated to be integral with inner surface 48 of upper wall 43. Well 45 comprises a depression in web 42 which is configured for slidingly mating engagement with drain port 26 and drain plug 27.

Housing 20 may be removably received into recess 47 so that outer surface 56 of bottom 25 is placed into abutting relationship with web 42 and so that drain port 26 and drain plug 27 may be slidingly and matingly inserted into well 45. Peripheral ridge 28*a* of bottom 25 matingly engages with bumps 46 to, in turn, selectively secure base 40 to housing 20.

Referring to FIG. 1, rear portion 65 of housing 20 may be coated or treated so as to be rendered substantially opaque. It is contemplated that front portion 66 of housing 20, which is operably associated with front wall 31 of display chamber 30, be substantially transparent, so as to allow viewing of an object within display chamber 30.

In use, base 40 may be removed from housing 20, thus allowing access to aperture 29 and the interior region of display chamber 30. Support 38 and thin object 60, which may be a photograph or other thin sheet, may be inserted into the interior region of the display chamber, so that the thin object is in abutting relationship with the front wall 31 of the display chamber. Base 40 may then be reattached to the bottom of the housing 20, and the photo display globe may be placed on a table, desk, shelf, or other surface where a decorative novelty item is desired. The photo display globe may be agitated, as desired, so as to actively place particles 51 into suspension with liquid 50, and, in turn, give the appearance of swirling snow around the object displayed in the display chamber.

The foregoing description and drawings merely explain and illustrate the invention and the invention is not limited thereto except insofar as the appended claims are so limited, as those skilled in the art who have the disclosure before them will be able to make the modifications and variations therein without departing from the scope of the invention.

We claim:

1. A novelty item comprising:

a housing having an outer portion and an inner portion and comprising an upper shell and a bottom portion which cooperate to define a liquid-tight cavity therebetween;

a liquid-tight display chamber integrated with said housing, said display chamber extending from said outer portion of said housing into said cavity;

said display chamber having an interior region, an exterior region and means for accessing said interior region of said display chamber, said accessing means extending from said outer portion of said housing to said interior region of said display chamber, to in turn, facilitate placement of an object within said interior region of said display chamber;

a liquid received in said cavity so as to provide a cavity which is substantially liquid filled; and said interior region of said display chamber being shielded from direct contact with said liquid so as to provide a substantially liquid-free display chamber.

2. The invention according to claim 1 wherein said exterior region of said display chamber has a front wall.

3. The invention according to claim 2 wherein said front wall is substantially rectangular.

4. The invention according to claim 1 wherein said display chamber is configured to receive a thin object.

5. The invention according to claim 4 further comprising support means within said display chamber for supporting said thin object behind said front wall of said display chamber.

6. The invention according to claim 5 wherein said support means comprises a piece of expanded foam.

7. The invention according to claim 4 wherein said object is a thin sheet.

8. The invention according to claim 1 wherein at least a portion of said upper shell is substantially transparent.

9. The invention according to claim 1 wherein at least a portion of said upper shell is substantially opaque.

10. The invention according to claim 1 wherein said upper shell is substantially dome shaped.

11. The invention according to claim 1 wherein said housing further comprises drainage means.

12. The invention according to claim 11 wherein said drainage means comprises:

a drain port located within said bottom portion of said housing; and a plug operatively associated with said drain port for selectively sealing said liquid within said housing.

13. The invention according to claim 12 wherein said drain port is integral with said bottom portion.

14. The invention according to claim 1 further comprising a base for supporting said housing.

15. The invention according to claim 14 wherein said base is configured to cover said accessing means.

16. The invention according to claim 1 wherein the liquid contains a plurality of particles therein.

17. The invention according to claim 1 wherein said base is removable from said housing.

18. The invention according to claim 1 wherein said access means comprises said housing having an aperture formed in the outer portion of said housing.

19. The invention according to claim 1 wherein the display chamber comprises greater or fewer walls than to define a rectangular configuration, so as to define other shapes.

20. The invention according to claim 1 wherein the display chamber is substantially uniform in thickness.

21. A novelty item comprising:

a housing having an outer portion and an inner portion and comprising an upper shell and a bottom portion which cooperate to define a liquid-tight cavity therebetween;

a liquid-tight display chamber associated with said housing, said display chamber extending from said outer portion of said housing into said cavity;

said display chamber having an interior region and an exterior region, the display chamber being configured to receive a thin object;

support means within said display chamber for supporting said thin object behind said front wall of said display chamber, wherein said support means comprises a piece of expanded foam;

access means in said housing leading from said outer portion of said housing to said interior region of said display chamber;

a liquid received in said cavity so as to provide a cavity which is substantially liquid filled; and said interior region of said display chamber being shielded from direct contact with said liquid so as to provide a substantially liquid-free display chamber.

* * * * *

UNITED STATES PATENT AND TRADEMARK OFFICE

CERTIFICATE OF CORRECTION

PATENT NO. : 6,027,774 C1
APPLICATION NO. : 90/006099
DATED : June 13, 2006
INVENTOR(S) : Neil Fine et al.

It is certified that error appears in the above-identified patent and that said Letters Patent is hereby corrected as shown below:

In the Ex Parte Reexamination Certificate:

Column 1
Line 48, between “a” and “plug”, insert --removable--

Column 2
Line 8, between “a” and “plug”, insert --removable--
Line 40, between “a” and “plug”, insert --removable--

Signed and Sealed this
First Day of May, 2012

David J. Kappos

David J. Kappos
*Director of the United States Patent and Trademark Office*

US006027774C1

(12) EX PARTE REEXAMINATION CERTIFICATE (5403rd)

United States Patent
Fine et al.

(10) Number: US 6,027,774 C1
(45) **Certificate Issued: *Jun. 13, 2006**

(54) PHOTO DISPLAY GLOBE WITH LIQUID FILLED SHELL

(75) Inventors: Neil Fine, Northbrook, IL (US); Cliff Lam, Tsuen Wan (HK)

(73) Assignee: Neil Enterprises, Inc., Vernon Hills, IL (US)

Reexamination Request:
No. 90/006,099, Aug. 28, 2001

Reexamination Certificate for:

| | |
|---|---|
| Patent No.: | **6,027,774** |
| Issued: | **Feb. 22, 2000** |
| Appl. No.: | **09/044,039** |
| Filed: | **Mar. 18, 1998** |

( * ) Notice: This patent is subject to a terminal disclaimer.

(51) Int. Cl.
*G09F 19/00* (2006.01)

(52) U.S. Cl. ..... 428/14; 40/406; 40/410; 446/267

(58) Field of Classification Search ..... 428/14; 40/406, 410; 446/267
See application file for complete search history.

(56) References Cited

U.S. PATENT DOCUMENTS

| | | | | |
|---|---|---|---|---|
| 2,144,551 | A | | 1/1939 | Skolnick |
| 4,879,824 | A | | 11/1989 | Galloway |
| 5,261,848 | A | | 11/1993 | Kaplan et al. |
| 5,442,869 | A | | 8/1995 | McDarren et al. |
| D375,411 | S | | 11/1996 | Hawkins |
| 5,971,831 | A | * | 10/1999 | Hsu ..... 446/267 |
| 6,438,878 | B1 | * | 8/2002 | Fine et al. ..... 40/409 |

OTHER PUBLICATIONS

Silvestri, Inc., "Silvestri Spring 1991 Catalog", p. 20, published at least as early as 1991.
Russ Berrie and Company, Inc., "Timeless Moments Frames From Russ", p. 12, published at least as early as 1993.

* cited by examiner

*Primary Examiner*—Elizabeth M. Cole

(57) ABSTRACT

A liquid-filled display globe is provided. The globe has a central dry chamber allowing objects to be displayed without immersion, while giving the appearance of being immersed. Particulate matter is suspended in the liquid, giving the appearance of swirling snowflakes when the liquid is agitated. A removable base provides access to the display chamber so that the object displayed therein can be easily replaced.

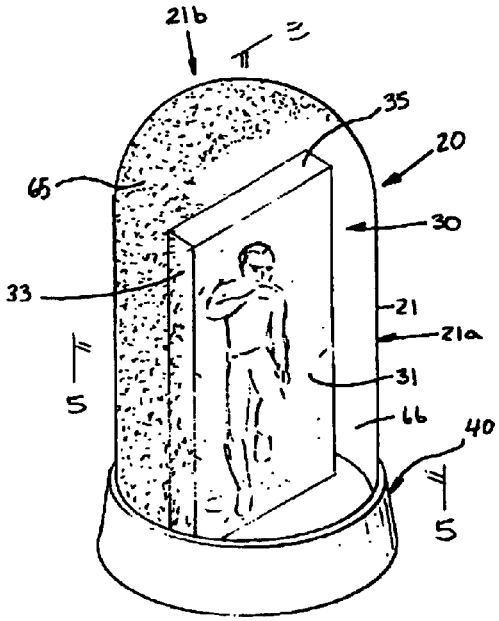

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 11–13 are cancelled.

Claims 1 and 21 are determined to be patentable as amended.

Claims 2–10 and 14–20, dependent on an amended claim, are determined to be patentable.

New claims 22–25 are added and determined to be patentable.

1. A novelty item comprising:

a housing having an outer portion and an inner portion and comprising an upper shell and a bottom portion which cooperate to define a liquid-tight cavity therebetween;

a liquid-tight display chamber integrated with said housing, said display chamber extending from said outer portion of said housing into said cavity;

said display chamber having an interior region, an exterior region and means for accessing said interior region of said display chamber, said accessing means extending from said outer portion of said housing to said interior region of said display chamber, to in turn, facilitate placement of an object within said interior region of said display chamber;

a liquid received in said cavity so as to provide a cavity which is substantially liquid filled; [and]

said interior region of said display chamber being shielded from direct contact with said liquid so as to provide a substantially liquid-free display chamber*;*

*a drain port located within said bottom portion of said housing; and*

*a plug operatively associated with said drain port for selectively sealing said liquid within said housing.*

21. A novelty item comprising:

a housing having an outer portion and an inner portion and comprising an upper shell and a bottom portion which cooperate to define a liquid-tight cavity therebetween;

a liquid-tight display chamber associated with said housing, said display chamber extending from said outer portion of said housing into said cavity;

said display chamber having an interior region [and], an exterior region, [the] *having a front wall, and means for accessing said interior region of said display chamber, said* display chamber being configured to receive a thin object;

support means within said display chamber for supporting said thin object behind said front wall of said display chamber, wherein said support means comprises a piece of expanded foam;

access means in said housing leading from said outer portion of said housing to said interior region of said display chamber;

a liquid received in said cavity so as to provide a cavity which is substantially liquid filled; [and]

said interior region of said display chamber being shielded from direct contact with said liquid so as to provide a substantially liquid-free display chamber*;*

*a drain port located within said bottom portion of said housing; and*

*a plug operatively associated with said drain port for selectively sealing said liquid within said housing.*

*22. The novelty item of claim 21 further comprising a base for supporting said housing, wherein said base is configured to cover said accessing means.*

*23. A novelty item comprising:*

*a housing having an outer portion and an inner portion and comprising an upper shell and a bottom portion which cooperate to define a liquid-tight cavity therebetween;*

*a liquid-tight display chamber integrated with said housing, said display chamber extending from said outer portion of said housing into said cavity;*

*said display chamber having an interior region, an exterior region and means for accessing said interior region of said display chamber, said accessing means extending from said outer portion of said housing to said interior region of said display chamber, to in turn, facilitate placement of an object within said interior region of said display chamber;*

*a liquid received in said cavity so as to provide a cavity which is substantially liquid filled;*

*said interior region of said display chamber being shielded from direct contact with said liquid so as to provide a substantially liquid-free display chamber;*

*a base for supporting said housing, wherein said base is configured to cover said accessing means; and*

*drainage means.*

*24. The invention of claim 23 wherein said drainage means comprises:*

*a drain port located within said bottom portion of said housing; and*

*a plug operatively associated with said drain port for selectively sealing said liquid within said housing.*

*25. A novelty item comprising:*

*a housing having an outer portion and an inner portion and comprising an upper shell and a bottom portion which cooperate to define a liquid-tight cavity therebetween:*

*a liquid-tight display chamber integrated with said housing, said display chamber extending from said outer portion of said housing into said cavity;*

*said display chamber having an interior region, an exterior region and means for accessing said interior region of said display chamber, said accessing means extending from said outer portion of said housing to said interior region of said display chamber, to in turn, facilitate placement of an object within said interior region of said display chamber;*

*a liquid received in said cavity so as to provide a cavity which is substantially liquid filled;*

*said interior region of said display chamber being shielded from direct contact with said liquid so as to provide a substantially liquid-free display chamber;*

*a base for supporting said housing, wherein said base is configured to cover said accessing means; and*

*support means within said display chamber for suppressing said object behind said front wall of said display chamber.*

* * * * *